United States Patent [19]

Malleone

[11] 4,154,318

[45] May 15, 1979

[54] RETRACTABLE SUSPENDED SCAFFOLDING ON A SELF-PROPELLED TRUCK, PARTICULARLY ADAPTED FOR MAINTENANCE WORK ON ROAD-BRIDGES AND THE LIKE

[75] Inventor: Antonio Malleone, Montecatini Terme, Italy

[73] Assignee: Autostrade-Concession Ecostruzioni Autostrade S.p.A., Rome, Italy

[21] Appl. No.: 849,673

[22] Filed: Nov. 8, 1977

[30] Foreign Application Priority Data

Nov. 9, 1976 [IT] Italy ..... 52090 A/76

[51] Int. Cl.[2] ..... B66F 11/04

[52] U.S. Cl. ..... 182/12; 182/19; 182/62.5; 182/63; 182/145

[58] Field of Search ..... 182/63, 62.5, 150, 142, 182/2, 12, 13, 14, 37, 36, 145, 19; 212/144

[56] References Cited

U.S. PATENT DOCUMENTS

| | | | |
|---|---|---|---|
| 3,608,669 | 9/1971 | Lindsay | 182/63 |
| 3,774,719 | 11/1973 | Lindsay | 182/63 |
| 4,044,858 | 8/1977 | Vikre | 182/150 |
| 4,074,790 | 2/1978 | Colbachini | 182/63 |

*Primary Examiner*—Reinaldo P. Machado

[57] ABSTRACT

There is disclosed a retractable suspended scaffolding mounted on a self-propelled truck which is particularly adapted for maintanence work on structures that are situated along roadways and at areas of difficult access. The scaffolding includes an operating gangway that is arranged in posiiton below the planking of a bridge, a viaduct or the like, by means of a set of mechanisms that are operated by oleodynamic jacks, hydraulic motors and manually controlled reduction units.

8 Claims, 8 Drawing Figures

RETRACTABLE SUSPENDED SCAFFOLDING ON A SELF-PROPELLED TRUCK, PARTICULARLY ADAPTED FOR MAINTENANCE WORK ON ROAD-BRIDGES AND THE LIKE

The need to check the stability and the good condition of bridges, viaducts and connected works, particularly along the roads and speedways and, furthermore, the need to provide their periodical routine and extraordinary maintenance, have resulted in the problem of obtaining an easy, practical and safe access to all the points of the structures of these works, starting from the roadway and with a minimum of encumbrance, in such a way as to cause a minimum hindrance to the vehicles moving therealong.

Until a few years ago, said maintenance and checking operations were feasible thereby avoiding carrying out provisional scaffoldings starting from the bases of the structures, only if fixed gangways had been foreseen at the planning stage, the same being built together with the main works, for the abovementioned purpose.

Recently, travelling platforms, mounted upon motor vehicles, have been utilized, which allow a quick and safe access under the structures of bridges, viaducts and the like, by means of a gangway supported by articulated arms oleodynamically controlled. Said travelling platforms have now achieved a remarkably high grade of perfection and automatism, but, because of their high cost, their use is advantageous only to perform periodical inspections and controls, taking into account their travelling and autonomy features, as well as the speed and simplicity of their installation.

It would be uneconomic, indeed, to immobilize such kind of equipment as scaffold for carrying out maintenance works for an undetermined length of time.

On the other hand, the costs of conventional scaffoldings and particularly of those intended for important works, which are generally situated in topographically difficult areas, are extremely high and affect the whole cost of intervention, taking into account the fact that, whatever be the maintenance to be done, provisional works must be erected from the base of the main structures.

The present invention concerns a retractable suspended scaffolding, mounted upon a self-propelled truck, particularly adapted for maintenance work on structures situated along the roads at areas of difficult access, the scaffolding being substantially composed of an operating gangway arranged to be positioned below the planking of a bridge, a viaduct or the like, by means of a set of mechanisms operated by oleodynamic jacks, hydraulic motors and manually controlled reduction units.

Such a scaffolding forms movable equipment easy to employ, has low costs of installation and operation in comparison with those of the heretofore known systems and satisfies every operating requirement in connection with the maintenance service of bridges.

Other features and advantages of the invention will appear from the following description and annexed drawings which represent non limitative example.

FIG. 1 schematically shows, in a plan view from above, partially sectioned, the scheme of a retractable suspended scaffolding, according to the invention, represented in a position in which the set gangway-sliding arm is hoisted from the self-propelled truck and is horizontally carried outside the bridge structure.

Figure 1:
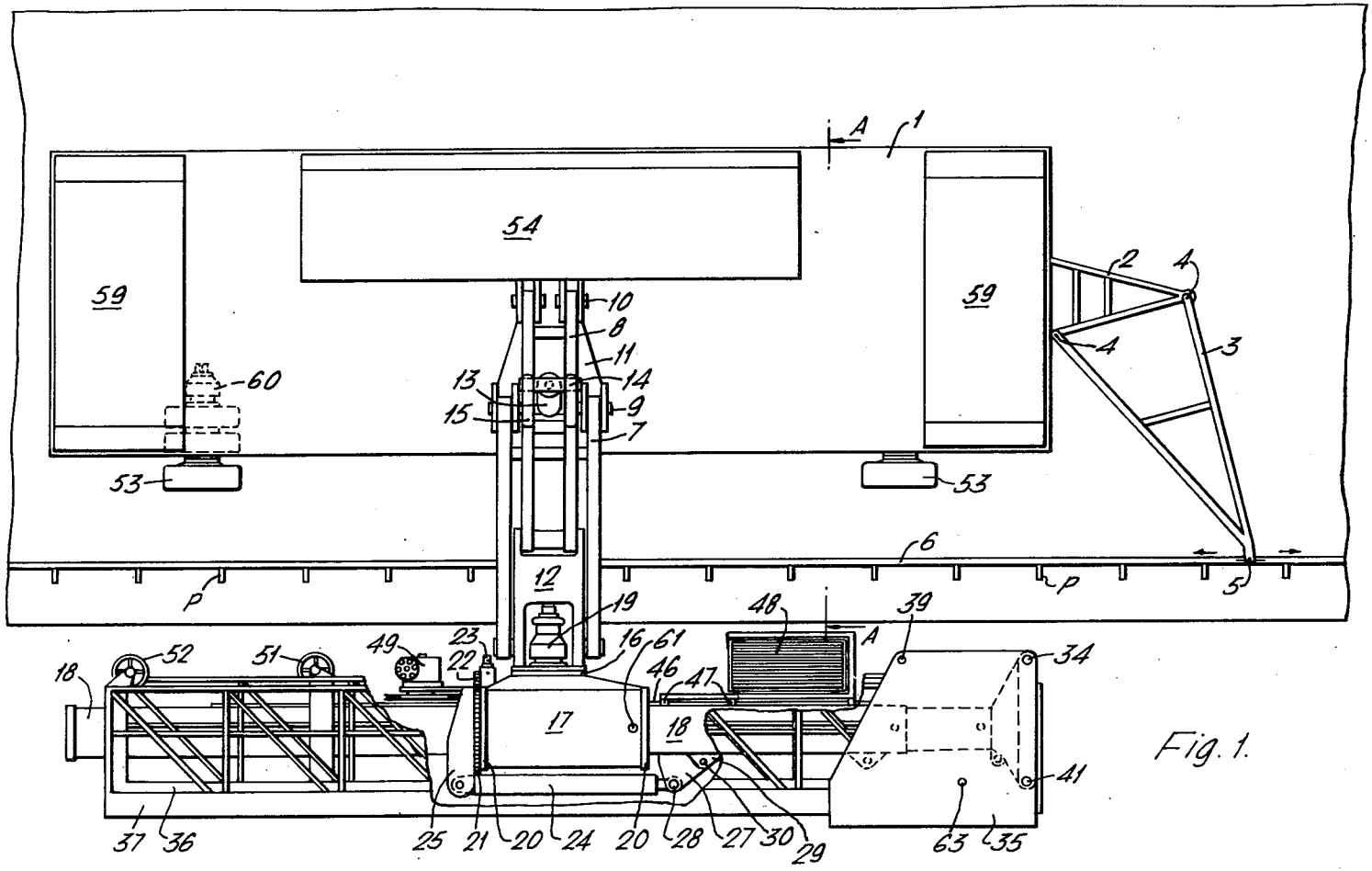
Figure 2:
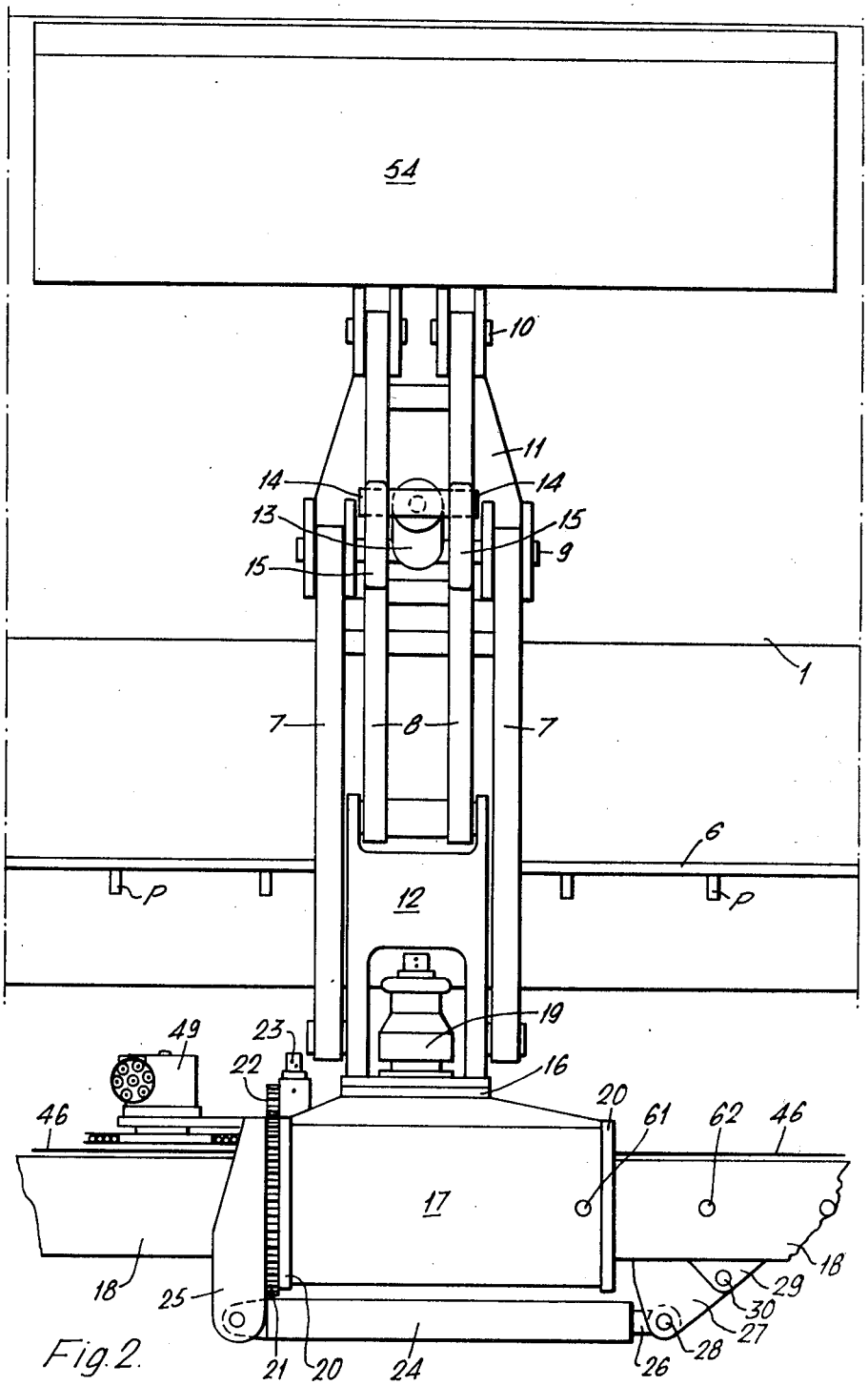
FIG. 2 is an enlarged portion of the structure shown in FIG. 1.
Figure 3:
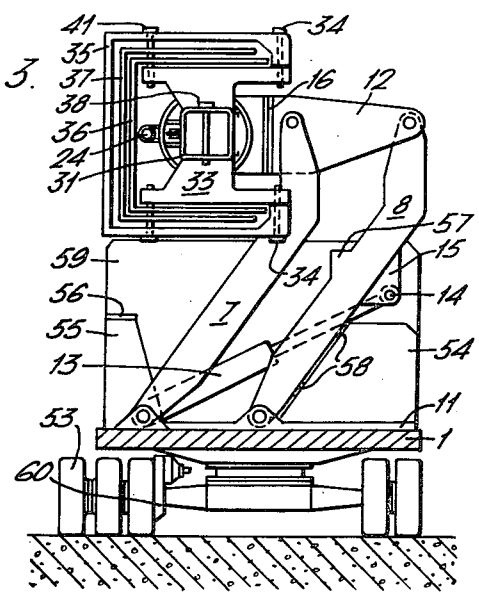
FIG. 3 shows, in a transverse elevational view partially sectioned along the line A—A of FIG. 1, the structure FIG. 1 represented in the closed position, i.e. with the set gangway-sliding arm retracted and arranged on board of the truck.
Figure 8:
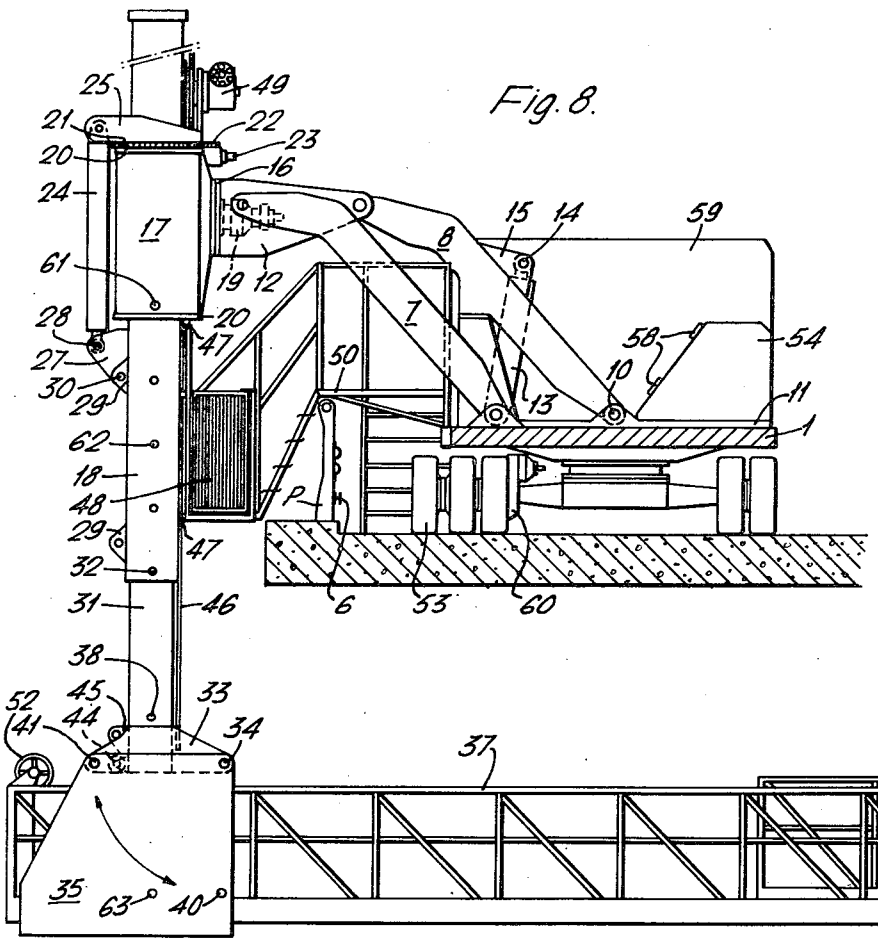
FIG. 8 is an elevational view that shows, in a view partially sectioned along the line A—A of FIG. 1, the structure of FIG. 1 represented in an in-use position below the bridge structure.
Figure 4:
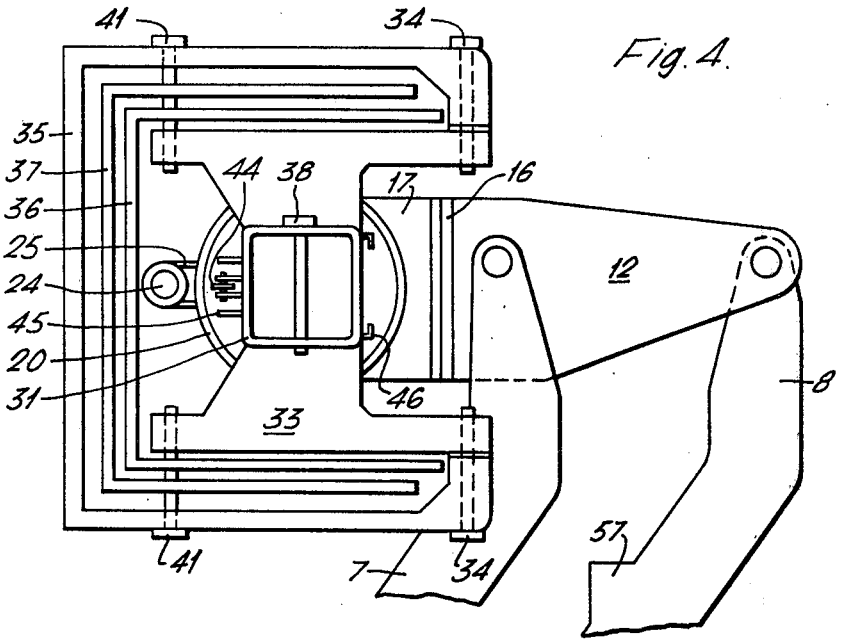
FIG. 4 is an enlarged portion of the structure shown in FIG. 3.
Figure 7:
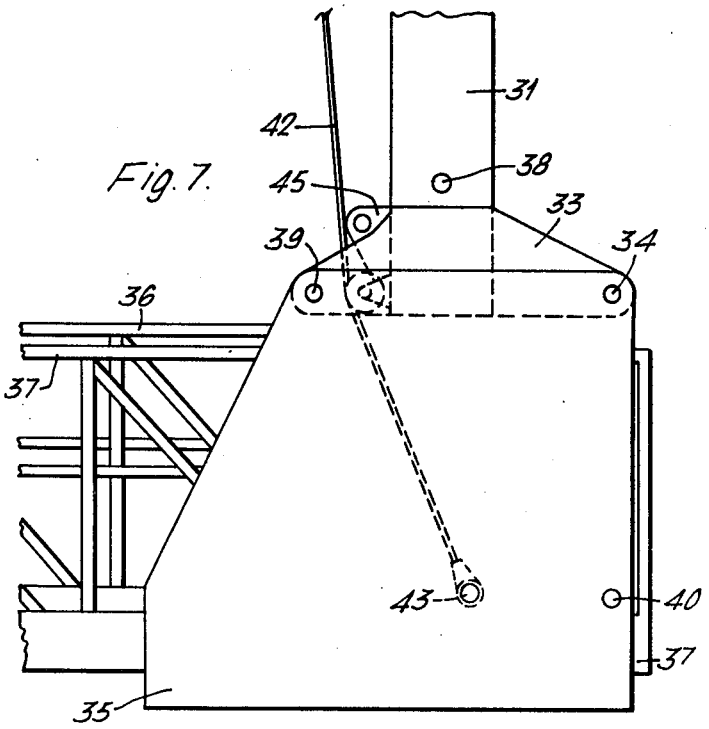
FIG. 7 is an elevational view illustrating a portion of the view of FIG. 6 on an enlarged scale.
Figure 5:
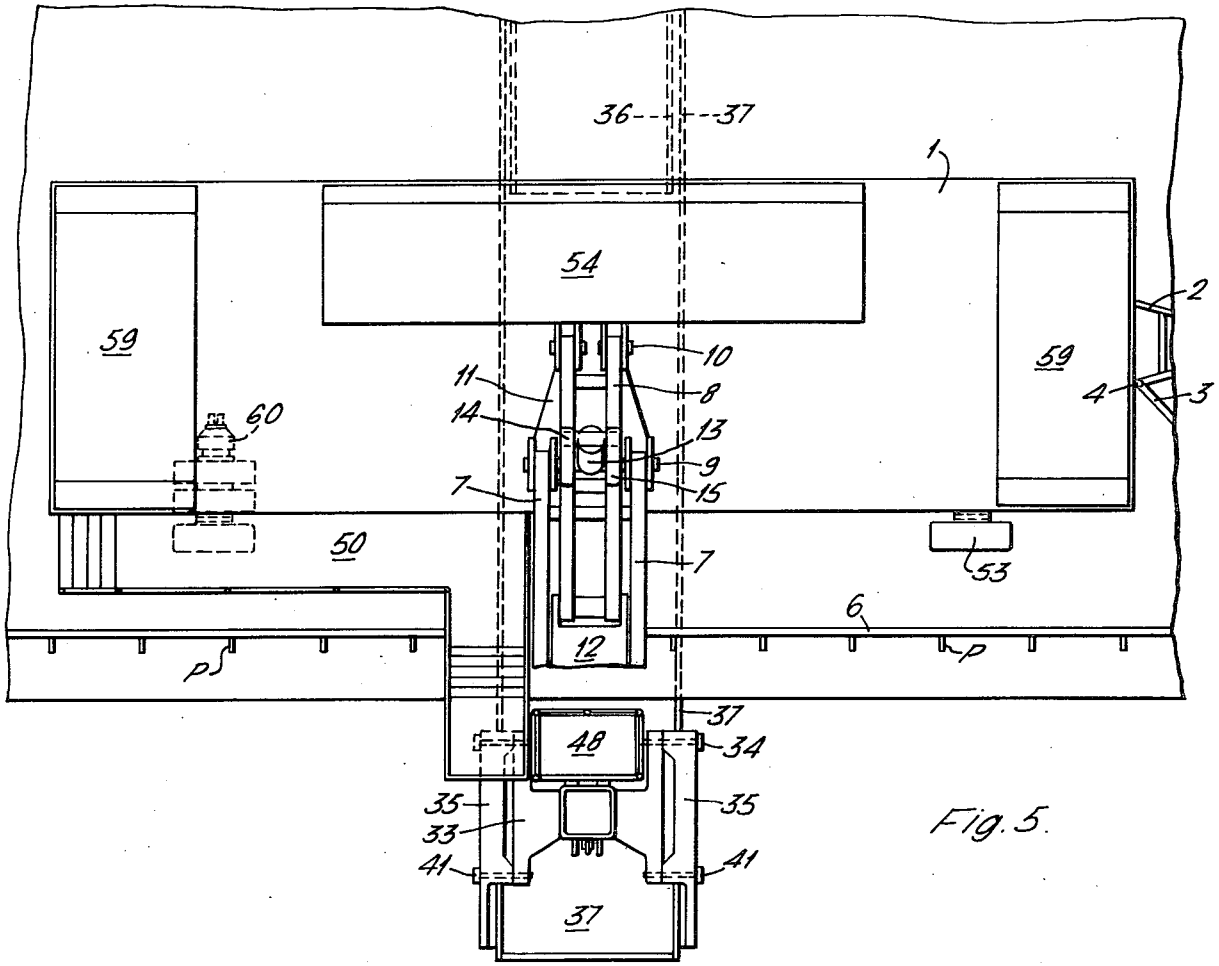
FIG. 5 shows, in a plan view from above, partially sectioned, the structure of FIG. 1 represented in a position in which the set gangway-sliding arm is vertically rotated.
Figure 6:
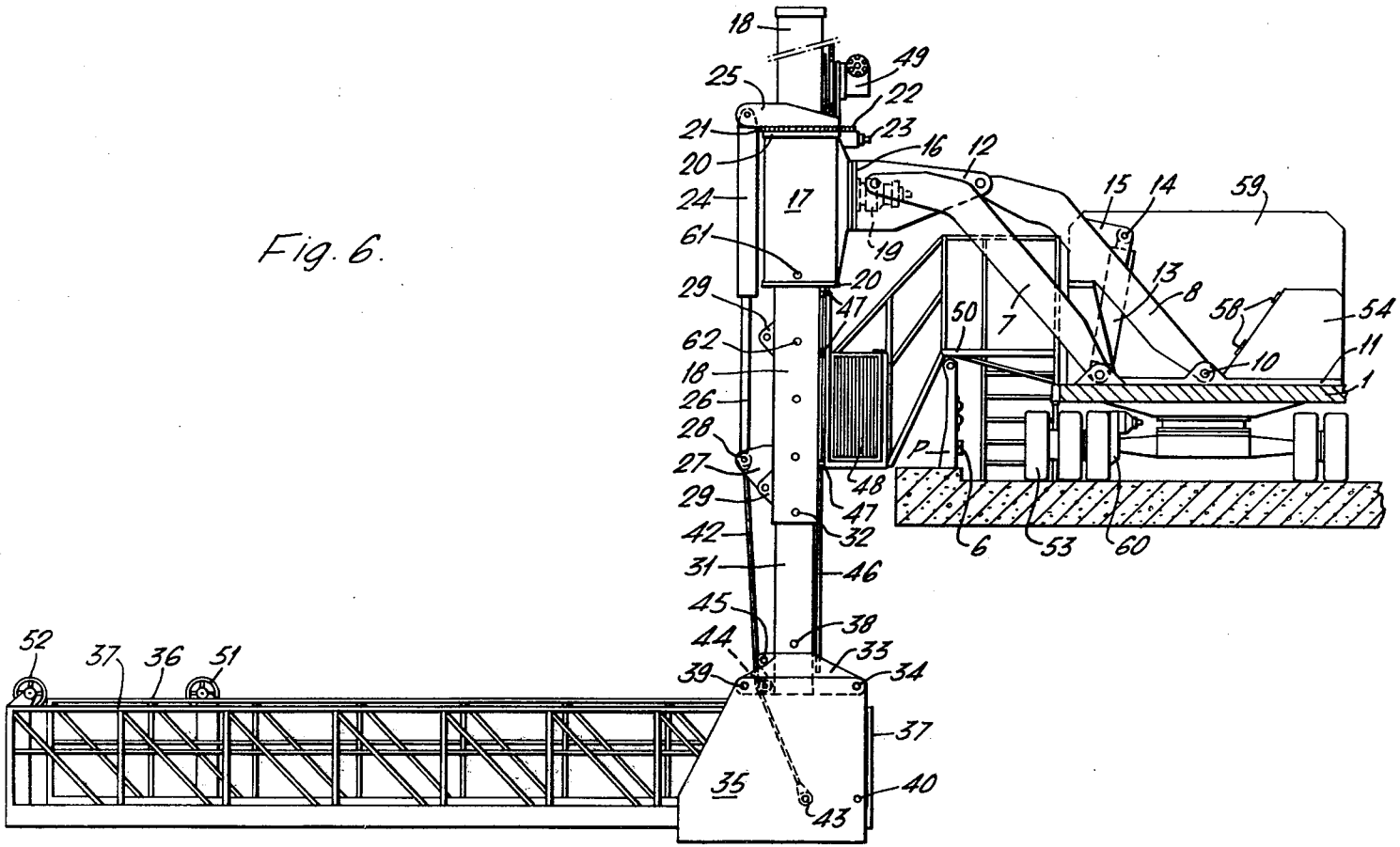
FIG. 6 shows, in a transverse elevational view partially sectioned along the line A—A of FIG. 1, the structure of FIG. 1 represented in a position in which the sliding arm is vertically arranged and the telescopic gangway is turned over horizontally at a 90° angle, outside the bridge structure.

As can be seen from the annexed drawings, the retractable suspended scaffolding, according to the invention, substantially consists of a truck or carriage 1, of a kind similar to that of a conventional flat-bed trailer, which can be towed by a tractor and which belongs to the class of vehicles which are not subjected to the issue of special circulation permits, both with respect to the size and to the weight.

The direction drawbar 2 of the truck 1 is provided in such way that on its right side, i.e. at the side looking on the shoulder of the road, a stiff triangle 3 can be mounted, this triangle being connectable, for instance, by means of bolts or spikes 4 passing through corresponding holes of the drawbar 2 and the triangle 3.

Near its free end, said triangle 3 is provided with a sliding element 5, for instance a shoe, a roller or the like, which allows the drawbar 2 to be coupled to a guide 6 consisting, for instance, of an H-beam fixed at a predetermined height to the pillarings P of the guardrail, without projecting outwardly of the guardrail itself.

Said guide 6 may be fixed firmly at the structures, or else it may be provisionally mounted when starting the maintenance work.

The triangle 3 is dimensioned in such way that the drawbar 2 is maintained at a 90° angle with respect to the guide 6 when the sliding element 5 is coupled to the guide itself.

Therefore, the forward and backward movements of the truck 1 will be certainly parallel to the road shoulder.

A similar device can be mounted backwards under the truck 1, particularly when also the rear axle is steering.

Upon the truck 1 an articulated parallelogram is mounted, which is composed of the pairs of arms 7 and 8, oscillating on one hand on the axles 9 and 10, respectively, supported by the ears of the base 11 integral with the flat-bed of the truck 1 and, on the other hand, kinematically coupled to a stiff connection and support member 12.

Said parallelogram is operated by means of a jack 13 constrained on the axle 9, the same on which also the pair of arms 7 can oscillate, and acting the axle 14 supported by the ears 15 of the pair of arms 8.

The member 12 which closes the articulated parallelogram is integral, forwards, with a sturdy center plate 16 adapted to support, ensuring its rotation in the vertical plane, a hollow support 17, within which an arm 18 is slidable, this arm having a square cross-section and being guided through said support 17 by means of cheeks with sliding shoes, lined with antifriction material, not represented in the figures.

The rotation of the support 17 in the vertical plane is controlled by means of a geared motor 19, arranged between the wings of the member 12.

Inwardly the support 17, in turn, is arranged to rotate about its own geometrical longitudinal axis, causing the rotation of the arm 18 too. The arm 18 and the support 17 can be locked together, at least in a position of the inner part of the support 17 which can rotate in respect to the outer part, by means of a pin 61 passing through any of the pair of holes 62 provided on the facing faces of the arm 18 and a pair of holes, diametrically opposed, provided on the outer part of the support 17. Said rotation is assured, as can be seen in the annexed drawings, by means of the two center plates 20 and the gear wheel 21 coupled to the pinion gear 22 which is operated by the motor 23.

Outwards of the support 17 a second hydraulic jack 24 is provided, which is supported by means of brackets 25 integral with the gear wheel 21, whose rod 26 acts downwardly along a vertical path, causing the sliding motion of a two-winged shoe 27 along the outer face of the arm 18, said shoe 27 being connected to the rod 26 of the jack 24 by means of the pin 28. The respective face of the sliding arm 18 is provided with ears 29, arranged to be connected to the shoes 27 through the pin 30.

The height of the ears 29 is such that the ears themselves can pass through the hollow support 17 in the space between the two cheeks (not represented) which guide the sliding arm 18.

The abovementioned arm 18 shows in its lower part a telescopic extension 31, connected on and locked to it by means of a pin 32 passing through corresponding holes of the elements themselves, respectively 18 and 31, said extension 31 being in turn integral, at its lower end, with a header 33 which is coupled through pins 34 to a bracket-shaped support 35, provided for supporting two telescopic elements, respectively 36 and 37, with their floor and their railings, which form the operating gangway according to the invention.

The coupling of the supporting-bracket 35 to the header 33 by means of the pins 34, one for each side, is such to allow a rotation angle of 90° at least of the support 35 with respect to the header 33, which is made integral with the extension 31 of the sliding arm 18 by means of a pin 38 passing through corresponding holes of the two elements, respectively 31 and 33. There is no reason, however not, to a make the header 33 integral with the element 31 by means of a welding.

The support 35 of the gangway 36–37 presents on the two side frames two holes, respectively 39 and 40, which are equidistant from the axis of the pins 34 and are 90° apart from each other, so that when said support 35 is made to rotate by 90° in one direction or the opposite, one of the two holes 39 or 40 coincides with a corresponding hole which is provide on the header 33 along the same horizontal alignment but at the opposite end with respect to the hole within which the pin 34 is inserted.

More exactly, when the gangway 36–37 is in the open position on the said hole of the header the hole 39 will be found, whereas when the gangway is closed in order to be retracted aboard the truck, it will be the hole 40 that will be in correspondence with the header hole. A pin 41, inserted into one of said couplings of holes, locks the support 35 and the gangway 36–37 into the desired position.

All this is true also for the opposed side frame.

For hoisting and lowering the support 35 and the whole gangway unit 36–37, a length of steel cable 42 of a suitable strength is used provided at the ends with sturdy terminals adapted to be connected on one side to the stem 26 of the jack 24 by means of the pin 28 and on the other side to a suitable bar 43 introduced and fixed betweeen the two holes 63 of the support 35 when said operations have to be done. It is obvious that the connection of the cable 42 with the support 35 can be completed or replaced by other devices of a known kind. The line of action of the cable itself is discharged sideways through the shoe 27 and a rolling member 44 provided on the header 33, for instance a roller fixed in a rotatable way between the ears 45 which are provided for the hoisting of the unit.

The face of the elements 18 and 31 opposed to that on which the shoe 27 slides, is provided with parallel rectilinear guides 46 in which slide the shoes 47 of a service elevator-basket 48 controlled by a hydraulic windlass 49.

Superiorly, the access to the basket 48 for the operating personnel and the loading of the materials necessary for the maintenance works is facilitated by a decomposable footboard 50, with its small stepladders and/or ramps which connect it both with the roadway and the upper station of the basket. Once the work is completed, the footboard with its accessories is disassembled and loaded on board of the truck 1.

Below, the station of the basket 48, whose side walls are adapted lowered to be in all directions, corresponds with the walking plane of floor of the telescopic member 36, i.e. of the internal telescopic member.

Therefore, by means of the basket 48, the operator of the retractable suspended scaffolding according to the invention, is in condition to reach easly and safely the manual controls 51 and 52, for instance handwheel-cranks which operate reduction units controlling the steel rope and transmission systems for the sliding of the telescopic members, respectively 36 and 37, within the supporting-bracket 35 and for the forward motion of the inner member 36 with respect to the external member 37, until the maximum total length has been reached.

All the elements which comprise the retractable suspended scaffolding are dimensioned in such a way to allow that at the end of the gangway 36, when this is in the maximum extension position, a live load may be placed which is certainly advantageous in connection with the economy of the work to be done.

It is obvious that, excepted the rest retracted position, every different position of the gangway-sliding arm unit has a tendancy to displace outwardly the center of gravity of the suspended scaffolding.

For this reason, on the right side of the truck 1, in correspondence with the right wheel of each axle, a supplemental stabilising wheel 53 is advantageously placed. Said wheel 53, for instance, may be applied by coupling its rim and that of the corresponding wheel by means of suitable bolts and/or dap joints.

Furthermore, there is provided on the left side of the truck a longitudinal container for ballasting materials, in such a way to compensate the moment which could cause the overturning of the scaffolding-truck unit.

Furthermore, in order to avoid oscillations of the whole apparatus both during its utilisation and its displacements, supports 55 are provided on the right side of the truck 1, these supports being lined with a layer 56 of an adequately plastic material, for instance a block of hard rubber, on which they rest suitable heels 57 obtained along the profile of the arms 8. Similar blocks 58 of an adequately plastic material are provided at the container 54, on which the arms 8 will rest in their rest and travel positions.

Other containers with movable doors 59 are situated at the two frontal ends of the truck 1 for the purpose to house the heat engines, the electric alternators, the compressors, the tanks and the control switchboards, all of a conventional structure, serving the described equipements.

Said equipements may be remotely controlled by means of two push-button panels, one of which will be on the suspended gangway and the other at ground level.

As has been described, the truck 1 is equipped in such way that it can effect displacements in the two directions parallel to the road shoulder. These displacements are obtained by means of a geared motor unit 60 applied, for instance, to the twin wheel of the fixed rear axle of the truck, this unit 60 being controllable both from ground position and from the gangway, by means of the abovementioned push-button panels.

The retractable suspended scaffolding according to the invention, as described and specified, is therefore suitable, as will be understood from the following, for:

- operating between the longitudinal parallel beams of bridges and viaducts;
- inserting or penetrating between the meshes or elements of reticular beams or trusses, provided that the headroom be at least equal to the transverse dimensions of the gangway;
- operating under the structures of viaducts, even in the presence of very high beam;
- operating along the lateral sides of the viaducts;
- effecting displacements along the structure to be repaired, without causing the displacement of the operator from the operating position.

All of the foregoing does not require the intervention of auxiliary equipement and/or means with which the scaffolding is not yet provided.

This stated, in order to effect the positioning of the suspended gangway under the bridge, one will proceed in the following way:

The stiff triangle 3 will be mounted on the drawbar 2 by means of the bolts 4 and the sliding element 5 will be inserted into the guide 6, which has been previously fixed on the pillarings P of the guardrail. Successively, the supplemental wheel 53 will be applied to the corresponding wheels of the the truck 1 on the right side of the truck itself, that is on the side adjacent the road shoulder.

Now, by operating the jack 13, the gangway-sliding arm set will be brought outwardly with respect to the structure and then, by means of the gear motor unit 19, this set will be put into a vertical position. At this moment, operating from the inside of the basket 48, by means of the pin 30 the shoe 27 has to be connected to the ear 29 and the sliding arm 18 has to be freed from its support 17 by removing the pin 61. Thus, operating the jack 24 in the opening direction, the assembly will be lowered to the desired height in such a way as to bring a pair of holes 62 of the sliding arm in correspondence with those of the fixed portion of the support 17 and, finally, the pin 61 has to be again inserted.

In the case that the length of the rod 26 of the jack 24 were insufficient to reach the desired lowering, one must proceed in the following way:

The shoe 27 has to be unlocked from the already utilized ear 29, the rod 26 has to be lifted causing the raising of the shoe 27 which will be connected to a new ear 29 situated at a higher level than the previous one, the pin 61 has to be removed and the jack 24 will be operated again in the opening direction. The operation has to be repeated until the desired depth has been reached, this position being assured by the final locking of the arm 18 to the support 17 inserting the pin 61 again.

Once these preliminary operations have been effected, in order to achieve the outward lowering and the opening of the gangway 36–37 it is necessary to connect the ends of the cable 42, on one side to the stem 26 of the jack 24 by means of the pin 28, and on the other side to a suitable bar 43 which is inserted and fixed between the two holes 63 of the support 35, one hole 63 on each body side of the support 35.

After removing the locking pins 41 and extracting the pin 30 in such a way as to free the shoe 27 from the ear 29, the jack 24 is operated in the opening direction until the support 35 and the gangway 36–37 will be brought gradually into their final position, 90° apart from the sliding arm 18, that is into a horizontal position.

Once this position has been reached, it is necessary to lock the support 35, which is rotatable about the pins 34, and this is done by inserting the pins 41 into the two holes 39 in connection with the corresponding holes which are provided at the end of the header 33.

Successively, by means of the manually operated reduction unit 52, the members 36 and 37 are made to slide through the support 35 for their whole length and by means of the second reduction unit operated by the manual control 51, the inner element 36 of the gangway is extracted, until the maximum total length is reached.

Thus, the gangway, or scaffolding, according to the invention, is in its working position, ready to be utilized.

Obviously, in order to effect the closing of the gangway and to bring it aboard the truck, the same operations in reverse order shall be made.

It is possible that for effecting a work or a check, a displacement along the longitudinal axis of the bridge structure might be necessary. In this case, it will sufficient to operate the gear reduction unit 60 through one of the two push-button panels and it will carry out the displacement of the whole scaffolding, the same remaining in its open position.

Furthermore, in order to get around the bridge piers it will sufficient to make the element 36 re-enter the element 37 and, operating the manual control 52, to effect the sliding of the 36–37 unit through the support 35 until an intermediate position is reached, so that a balance of the masses with respect to the sliding arm 18 in obtained. Successively the gangway is brought into a position parallel to the bridge by operating the motor reduction unit 23 which controls the rotation of the support 17 and of the arm 18.

Obviously, before effecting said rotation it is necessary to clamp the sliding arm-gangway set to the shoe 27 which is connected to the jack 24 and to extract the pin 61 which locks the arm 18 to the support 17. Once the obstacle has been overcome, the gangway is again arranged under the bridge structure operating according to the reverse sequence.

Finally, the gangway may be advantageously utilized also keeping it parallel to the structure, for instance the lateral side of a bridge, of a viaduct or the like.

I claim:

1. A retractable suspended scaffolding, particularly adapted for maintenance work upon the bridge structures along roads, at points or areas to difficult access, characterized by the fact that it essentially consists of a working gangway capable of being arranged and kept suspended under the structure of a bridge, a viaduct or the like, by means of a set of mechanisms operated by oleodynamically controlled jacks, hydraulic motors and manually controlled reduction units; that such mechanisms with their controlling means are mounted on a self-propelled flat-bed truck capable of automatically keeping a path parallel to the shoulder of the road, and that the mechanisms themselves comprise substantially, in the order, an articulated parallelogram which is integral with the plane (11) of the truck (1), operable through an oleodynamically controlled jack (13) and comprised of two pairs of arms, or cranks (7,8), kinematically associated to a stiff connection and support member (12) acting as a connecting rod; a center plate (16) driven by a motor reduction unit (19), integral with said connecting member (12) of the parallelogram and capable of supporting, assuring its rotation on the vertical plane, a hollow support (17) within which an arm (18) that is square-shaped in cross-section is slidable, guided through said support (17) by means of cheeks with sliding shoes lined with an antifriction material, said arm (18) being provided with a plurality of connection elements, ears (29), longitudinally distributed at predetermined intervals along one of its faces and with a plurality of pairs of holes (62) longitudinally distributed at predetermined intervals along the opposing faces which are adjacent to the first-named face; a pair of center plates (20) arranged at the two ends of the hollow support (17) and of which one at least is integral with a gear wheel (21) coupled with a driving pinion (22), adapted to assure inside the support itself the rotation of the slidable arm (18) together with its guiding cheeks;

a hydraulic jack (24) situated parallel to the hollow support (17) and supported by means of brackets (25) which are integral with the gear wheel (21), the rod (26) of the jack (24) acting downwardly along a vertical path, causing the running along the external corresponding face of the slidable arm (18) of a shoe (27) connected to said rod (26) by means of an extractable pin (28);

a telescopic extension (31) of the slidable arm (18) having in the lower portion a header (33) coupled by means of a pin (38) to a bracket-shaped support (35) capable of effecting a rotation, in the vertical plane, of 90° at least with respect to said header (33) provided for supporting two reticular telescopic members (36,37) which substantially constitute the working gangway;

manually controlled reduction units (51,52) connected to steel rope and transmission systems for sliding of the reticular telescopic elements (36,37) and their forward and backward displacement;

a pair of rectilinear parallel guides (46) arranged along the face of the slidable arm (18) which is opposed to that which is provided with clamping or connecting ears (29), within said guides (46) sliding shoes (47) of an elevator service basket (48) controlled by a hydraulic windlass (49);

stabilizing supplemental wheels (53) applied in correspondence of the right wheel of each axle of the truck (1);

a motor reduction unit (60) applied to the twin wheel of the rear fixed axle of the truck (1), this reduction unit (60) being controllable by means of push-button panels both from the ground level and from the gangway.

2. A retractable suspended scaffolding according to claim 1, characterized by the fact that the outward lowering or the raising of the gangway unit (35,36,37) is carried out by means of a length of the steel rope (42) provided at the ends with sturdy terminals adapted to be connected on one side to the stem (26) of the jack (24) parallel to the hollow support (17) and on the other side to a suitable bar (43) inserted and fixed between two holes (63) provided on two sides of the support (35) which supports the gangway, the length of the stroke of the jack stem (26) being such that the bar (43) may run along a 90° are at least, in the two directions.

3. A retractable suspended scaffolding according to claim 1, characterized by the fact that on the header (33) which is integral with the telescopic extension (31) of the slidable arm (18) holes are provided for locking the support (35) which supports the gangway (36,37) at the two limit-position, 90° apart from each other.

4. A retractable suspended scaffolding according to claim 1, characterized by the fact that on the header (33) a rolling element is provided, for instance a roller (44) rotatable between a pair of ears (45) for the raising of the assembly (18,31,35,36,37).

5. A retractable suspended scaffolding according to claim 1, characterized by the fact that the hollow support (17) and the slidable arm (18) can be locked together, at least at a position of the rotatable inner part with respect to the outer part of the support (17), by means of a pin (61) passing both through a pair of diametrically opposed holes provided on the outer part of said support (17) and any of the pairs of holes (62) provided on two opposed faces of the slidable arm (18).

6. A retractable suspended scaffolding according to claim 1, characterized by the fact that the truck (1) is provided with supports which are lined by a layer of hard rubber, on which the arms of the articulated parallelogram rest, either in working position or in rest and displacement position.

7. A retractable suspended scaffolding according to claim 1, characterized by the fact that the truck (1) is provided with containers (54) adapted to be filled with ballast material.

8. A retractable suspended scaffolding according to claim 1, characterized by the fact that the truck (1) is provided with a decomposable footboard (50), with its small stepladders and/or ramps connecting it both to the roadway and to the upper station of the service-basket (48).

* * * * *

UNITED STATES PATENT AND TRADEMARK OFFICE

CERTIFICATE OF CORRECTION

PATENT NO. : 4,154,318

DATED : May 15, 1979

INVENTOR(S) : Antonio Malleone

It is certified that error appears in the above-identified patent and that said Letters Patent are hereby corrected as shown below:

On the front page please change the spelling of the Assignee from "Autostrade-Concession Ecostruzioni" to--AUTOSTRADE-Concessioni e Costruzioni--

Signed and Sealed this

*Seventh* Day of *April 1981*

[SEAL]

*Attest:*

RENE D. TEGTMEYER

*Attesting Officer*

*Acting Commissioner of Patents and Trademarks*